US011253879B2

(12) United States Patent
Santagiuliana

(10) Patent No.: US 11,253,879 B2
(45) Date of Patent: Feb. 22, 2022

(54) DEVICE FOR DISPENSING A MIXTURE, PREFERABLY A FOAM, AND SYSTEM USING SAID DEVICE

(71) Applicant: TAPLAST s.r.l., Vicenza (IT)

(72) Inventor: Evans Santagiuliana, Vicenza (IT)

(73) Assignee: TAPLAST s.r.l.

( * ) Notice: Subject to any disclaimer, the term of this patent is extended or adjusted under 35 U.S.C. 154(b) by 0 days.

(21) Appl. No.: 16/762,987

(22) PCT Filed: Oct. 29, 2018

(86) PCT No.: PCT/IB2018/058443
§ 371 (c)(1),
(2) Date: May 11, 2020

(87) PCT Pub. No.: WO2019/092547
PCT Pub. Date: May 16, 2019

(65) Prior Publication Data

US 2020/0276599 A1 Sep. 3, 2020

(30) Foreign Application Priority Data

Nov. 10, 2017 (IT) ..... 102017000128541

(51) Int. Cl.
*B05B 7/00* (2006.01)
*B05B 11/00* (2006.01)
*B05B 11/04* (2006.01)

(52) U.S. Cl.
CPC ..... *B05B 7/0037* (2013.01); *B05B 7/0025* (2013.01); *B05B 11/0059* (2013.01); (Continued)

(58) Field of Classification Search
CPC ..... B05B 7/0037; B05B 11/00444; B05B 11/0059; B05B 11/0078; B05B 11/043; B05B 7/0025
See application file for complete search history.

(56) References Cited

U.S. PATENT DOCUMENTS 4,836,422 A 6/1989 Rosenberg
5,310,093 A 5/1994 Bennett
(Continued)

FOREIGN PATENT DOCUMENTS

DE 9110905 U1 1/1993
WO WO2014016427 1/2014
(Continued)

OTHER PUBLICATIONS

International Search Report and Written Opinion dated Jan. 25, 2019; International Patent Application No. PCT/IB2018/058443 filed on Oct. 29, 2018. ISA/EP.

*Primary Examiner* — Frederick C Nicolas
(74) *Attorney, Agent, or Firm* — McDonald Hopkins LLC

(57) ABSTRACT

The present invention is a device for dispensing a mixture of a first fluid and a second fluid, suited to be applied to a container holding said fluids. The device comprises a mixing chamber for these fluids, a suction tube suited to draw the second fluid in order to convey it into the mixing chamber and a tank-chamber arranged between the suction tube and the mixing chamber. The device also deviates a quantity of the first fluid coming from the suction tube towards the tank-chamber.

18 Claims, 13 Drawing Sheets

(52) U.S. Cl.
CPC .... *B05B 11/0078* (2013.01); *B05B 11/00444* (2018.08); *B05B 11/043* (2013.01)

(56) References Cited

U.S. PATENT DOCUMENTS

| | | | | |
|---|---|---|---|---|
| 6,394,315 | B1 | 5/2002 | Banks | |
| 6,604,693 | B2 * | 8/2003 | Santagiuliana | B05B 7/0037 222/190 |
| 8,360,282 | B2 | 1/2013 | van der Heijden | |
| 8,529,637 | B2 * | 9/2013 | Vohra | A61K 8/046 8/405 |
| 8,622,252 | B2 * | 1/2014 | Kerr | A61K 8/046 222/190 |
| 9,718,070 | B2 | 8/2017 | Arminak | |
| 10,898,911 | B2 * | 1/2021 | Santagiuliana | B05B 11/3087 |
| 2002/0153389 | A1 | 10/2002 | Creaghan | |
| 2002/0179735 | A1 | 12/2002 | Santagiuliana | |
| 2005/0098581 | A1 | 5/2005 | Long | |
| 2009/0001100 | A1 | 1/2009 | van der Heijden | |
| 2015/0078117 | A1 | 3/2015 | Santagiuliana | |
| 2015/0224454 | A1 | 8/2015 | Albertz | |
| 2020/0238312 | A1 * | 7/2020 | Santagiuliana | B05B 7/0037 |

FOREIGN PATENT DOCUMENTS

| | | | | |
|---|---|---|---|---|
| WO | 2015097606 | A2 | 7/2015 | |
| WO | WO-2017103726 | A1 * | 6/2017 | B05B 11/3087 |

* cited by examiner

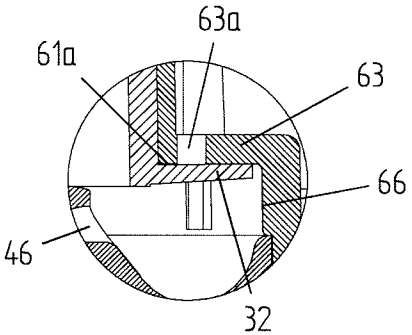
FIG. 9D
FIG. 9C
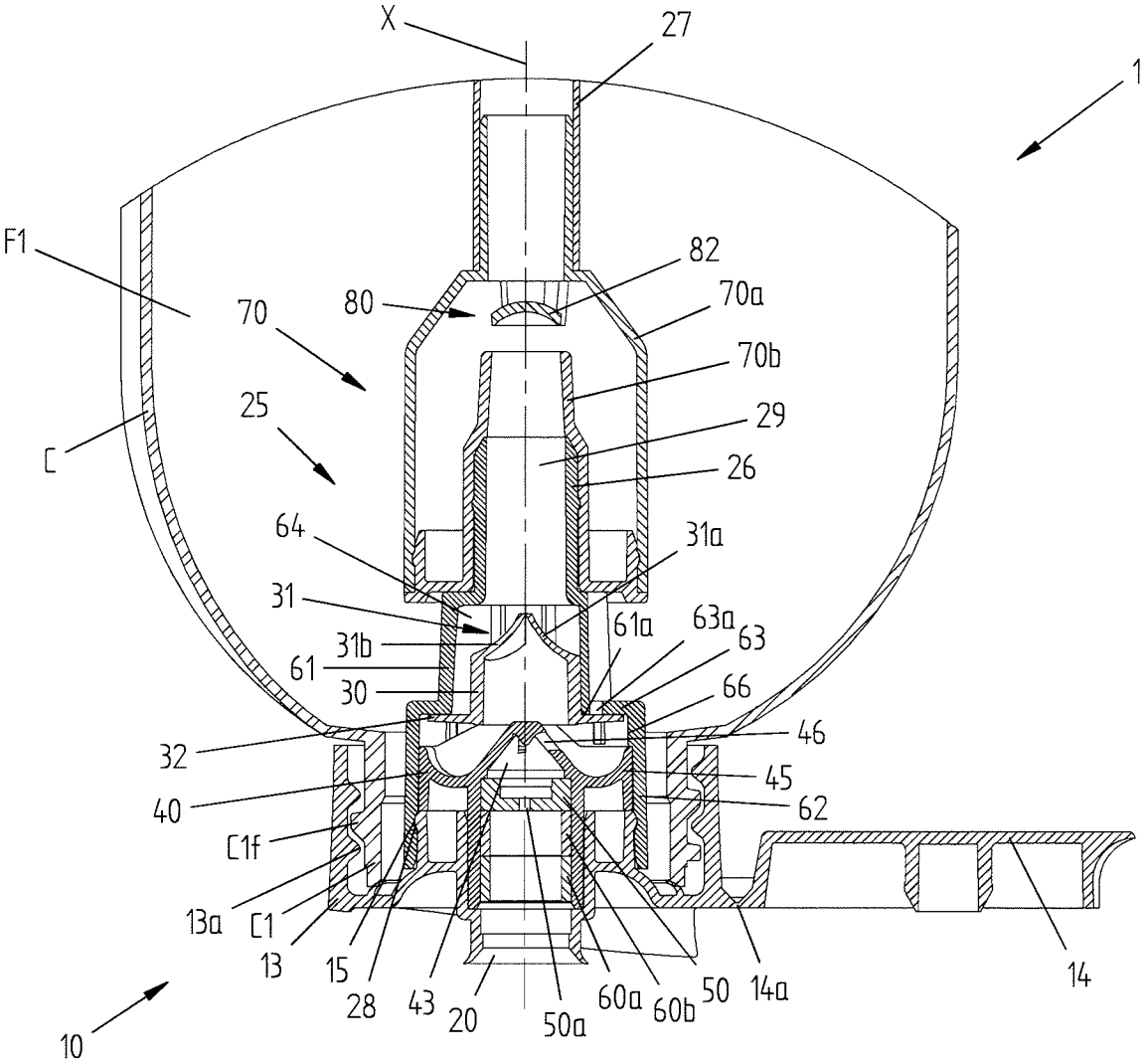

DEVICE FOR DISPENSING A MIXTURE, PREFERABLY A FOAM, AND SYSTEM USING SAID DEVICE

CROSS-REFERENCE TO RELATED APPLICATION

This application is a 35 U.S.C. 371 national stage filing of PCT Application No. PCT/IB2018/058443 filed Oct. 29, 2018, entitled "DEVICE FOR DISPENSING A MIXTURE, PREFERABLY A FOAM, AND SYSTEM USING SAID DEVICE," which claims priority to Italian Patent Application No. 102017000128541 filed on Nov. 10, 2017, each of which are incorporated herein in their entirety by reference.

TECHNICAL FIELD OF THE INVENTION

The present invention concerns the technical field of the systems for dispensing mixed fluids.

More specifically, the present invention concerns the production of a device for dispensing a mixture of two fluids, which can be applied to a deformable container, preferably a container to be pressed manually, containing the two fluids themselves, especially for dispensing a mixture in the form of a foam.

The invention concerns also the implementation of a system for dispensing a mixture, said system comprising a container and a dispensing device applied to said container.

DESCRIPTION OF THE STATE OF THE ART

The use of dispensing devices which are applied to deformable containers, typically made of plastic, is known in the field of systems for dispensing products in the form of a foam, wherein said deformable containers are squeezed by exerting pressure manually, thus allowing the foam to be dispensed through said devices with the container turned upside down, meaning with the outlet duct of the device facing downwards.

In these dispensing systems the foam is produced by conveniently mixing a quantity of liquid and a quantity of air drawn from said containers.

The fields of application of these types of foam generation and dispensing systems are several. In the cleaning sector foams are produced which are used, for example, to clean bathrooms, glass panes, kitchen ovens, pieces of furniture, or to dispense soaps, shampoos or face cleaning products. As regards the personal hygiene and health care fields, the products in the form of foams are, for example, hand care products, hair products, skin care products, shaving foams, or even animal care products, for example for cats and dogs. Applications are also known in specific medical sectors, for example in the case of sun protection foams to be applied to the skin or other similar products.

The systems of the known type consist of a dispensing device applied to the neck of a container. In the dispensing device it is possible to identify a chamber which, during the manual deformation of the container, receives the liquid and the air drawn by a suction tube positioned in the container.

The mixture of liquid and air received in this chamber flows out of the same and is transformed into a foam owing to the presence of a filtering element provided with suitable micro holes which, also according to the viscosity characteristics of the liquid and to the quantity of air mixed with said liquid, make it possible to obtain the outflow of the mixture in the form of a foam.

The dispensing devices which are applied to the containers are substantially made up of a supporting structure provided with means that enable it to be coupled with the neck of the container and with a suction unit designed to draw the fluids from the inside of the container and to produce the foam which will be successively dispensed.

The foam generated in this way is dispensed through a suitable outlet duct.

These types of dispensing systems can be used both in the upright and in the overturned position. It has been observed that in the case of use with overturned container, for example when dispensing foam on sanitary systems or oven plates or similar surfaces, in the first dispensing cycle the mixture that flows out of the container is a liquid and not a foam. This happens because the liquid contained in the suction tube that draws it from the inside of the container is discharged due to gravity so quickly that the formation of the correct mixture of liquid and air is not possible.

A known system that overcomes this drawback is described in the patent document EP1237660B1. In this system, the dispensing of the mixture in the form of a foam is guaranteed since the first dispensing cycle.

For this purpose, this system of known type is provided with a second chamber, in addition to the mixing chamber, which is suited to contain the volume of liquid present in the suction tube. The second chamber, or tank-chamber, has a volume which is at least larger than the volume defined by the suction tube, in such a way that the volume of liquid present in the suction tube is transferred in said tank-chamber when the system is upside down and the liquid is not conveyed into the mixing chamber.

The tank-chamber is made so that it is coaxial with and external to the mixing chamber and the suction tube ends into said tank-chamber in a decentred position with respect to the central axis of the mixing chamber.

This system is also provided with an air venting system that makes it possible to suck a convenient quantity of air from the outside during the return of the container from its squeezed configuration obtained to carry out the dispensing operation to its normal configuration, that is, the configuration in which it is not squeezed.

At the end of the dispensing operation, when the deformed/squeezed container is released and thus returns to its normal shape, meaning not deformed/squeezed, the container is refilled with a given quantity of air in order to prevent it from remaining partially squeezed.

However, the dispensing systems known in the art pose some drawbacks.

A first drawback of said dispensing systems is represented by their complex construction structure, which is due in particular to the position of the suction tube with respect to the mixing chamber and the tank-chamber.

This also causes the system to have an inappropriate overall size.

Another drawback posed by the dispensing systems of the known type is constituted by the complex assembly of the several components that make it up.

It is the object of the present invention to at least partially overcome the drawbacks described above.

It is a first object of the invention to provide a dispensing system which is an alternative to the dispensing systems known in the art and which makes it possible to generate a mixture of two fluids starting from the first dispensing cycle.

It is another object of the invention to provide a dispensing system which makes it possible to generate a mixture of two fluids starting from the first dispensing cycle and has reduced overall dimensions compared to the systems of the known type.

It is a further object of the invention to provide a dispensing system for the generation of a mixture of two fluids which has lower production costs compared to the systems of the known type.

SUMMARY OF THE PRESENT INVENTION

The present invention is based on the general consideration that it is possible to at least partially overcome the problems observed in the known art through the construction of a dispensing device designed to dispense a mixture of a first fluid and a second fluid, wherein said device comprises a mixing chamber in which said fluids are mixed and a tank-chamber suited to store a quantity of one of said fluids coming from said container and is provided with deviation means suited to deviate said quantity of one of said fluids towards said tank-chamber.

According to a first aspect of the present invention, the subject of the same is thus a device for dispensing a mixture of a first fluid and a second fluid, said device being suited to be applied to a container containing said fluids and comprising:

- an outlet duct for said mixture;
- at least one mixing chamber suited to receive and/or allow the transit of a quantity of said first fluid and a quantity of said second fluid;
- generation means suited to generate said mixture and arranged in said mixing chamber upstream of said outlet duct;
- a suction tube suited to draw said second fluid and convey it into said mixing chamber;
- a tank-chamber arranged between said suction tube and said mixing chamber, said tank-chamber being suited to store a quantity of said first fluid coming from said suction tube in order to prevent it from being conveyed towards said mixing chamber, wherein the device comprises deviation means suited to deviate said first fluid coming from said suction tube towards said tank-chamber.

Preferably, the device comprises first valve means comprising at least one first movable element suited to control the passage of the first fluid from the inside of the container towards the mixing chamber; second valve means comprising at least one second movable element suited to control the passage of the second fluid from the inside of said container towards the mixing chamber; third valve means comprising at least one third movable element suited to control the passage of a quantity of air from the outside of the container towards the inside of the container.

Preferably, at least two among the first movable element, the second movable element and the third movable element belong to a single valve element of the device.

More preferably, the first movable element, the second movable element and the third movable element belong to the same body that constitutes the valve element of the device.

In a preferred embodiment, the first movable element and the second movable element are constituted by a first flexible edge of the valve element, the first flexible edge being suited to assume a closed position, in order to interrupt the passage of the first fluid from the inside of the container towards the mixing chamber and to interrupt the passage of the second fluid from the inside of the container towards the mixing chamber, and to assume an open position, in order to allow the passage of the first fluid from the inside of the container towards the mixing chamber and the passage of the second fluid from the inside of the container towards the mixing chamber.

In a further preferred embodiment, said at least one third movable element of said third valve means comprises at least one flexible edge of the valve element, wherein said at least one flexible edge is suited to assume a closed position, in order to prevent the passage of the first fluid and/or the passage of the second fluid from the inside of the container, and is suited to assume an open position, in order to allow the passage of said quantity of air from the outside of the container towards the inside of the container.

Preferably, said at least one third movable element of said third valve means comprises two flexible edges of the valve element, which are suited to be placed in contact with each other in said closed position and to be spaced from each other in said open position.

In a preferred embodiment, the valve element comprises:

- a first flexible edge suited to define said first movable element of said first valve means and said second movable element of said second valve means;
- two flexible edges suited to define said at least one third movable element of said third valve means.

Preferably, the device according to the invention comprises a first body suited to receive the valve element, wherein the first body and the valve element are suited to define a first conveyance way designed to convey the first fluid from the container to the mixing chamber and a second conveyance way designed to convey the second fluid from the container to the mixing chamber.

According to a preferred embodiment of the invention, the first body comprises an inlet opening for the first fluid towards the mixing chamber.

In a preferred embodiment, the deviation means comprise a deviation element interposed between the suction tube and the inlet opening of the first body.

According to a preferred embodiment of the invention, the mixing chamber belongs to a mixer element arranged between the valve element and the outlet duct.

Preferably, the mixer element comprises stop means suited to stop at least one between the first movable element and the second movable element.

More preferably, the mixer element comprises stop means suited to stop the first flexible edge of the valve element.

In a preferred embodiment, the generation means designed to generate the mixture comprise a diffuser element and at least one filtering element.

According to a preferred embodiment of the invention, the diffuser element and said at least one filtering element are received in a seat in the mixer element.

Preferably, the mixture is a foam comprising the first fluid and micro bubbles of the second fluid. Preferably, the second fluid is air.

Preferably, the container is deformable, more preferably it can be deformed manually.

Preferably, the third valve means are designed to restore the presence of air inside the container.

According to another aspect of the present invention, the subject of the same is a system for dispensing a mixture of a first fluid and a second fluid, comprising a container for said fluids and a device for dispensing said mixture, said device being applied to said container, wherein the device is made as described above.

BRIEF DESCRIPTION OF THE DRAWINGS

Further advantages, objectives and characteristics of the present invention are defined in the claims and will be highlighted here below through the following description, with reference to the attached drawings. More specifically, in the drawings:

FIG. 9C shows an enlarged detail of FIG. 9B;

FIG. 9D shows an enlarged detail of FIG. 9C;

FIGS. 12A to 12F show different steps of use of the dispensing system of FIG. 1.

DETAILED DESCRIPTION OF THE PRESENT INVENTION

The example of embodiment of the invention described here below concerns devices for dispensing products in the form of a foam preferably resulting from the combination of a first fluid, typically in the liquid form, and a second fluid, typically air, both of which are present inside the container to which the device is applied.

Obviously, the proposed solution can be applied also to devices for dispensing foams in which the composition of the two fluids can be different, for example in the case of a fluid in the form of a cream.

Figure 2:
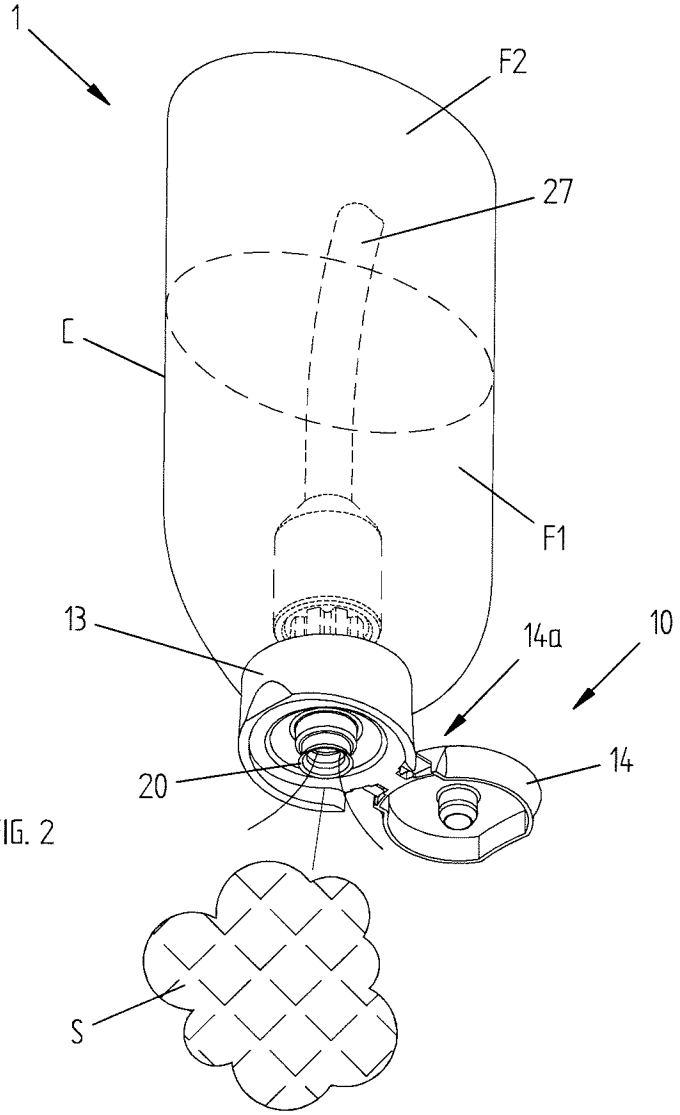
FIG. 2 shows the dispensing system of FIG. 1 in overturned position for use.
Figure 1:
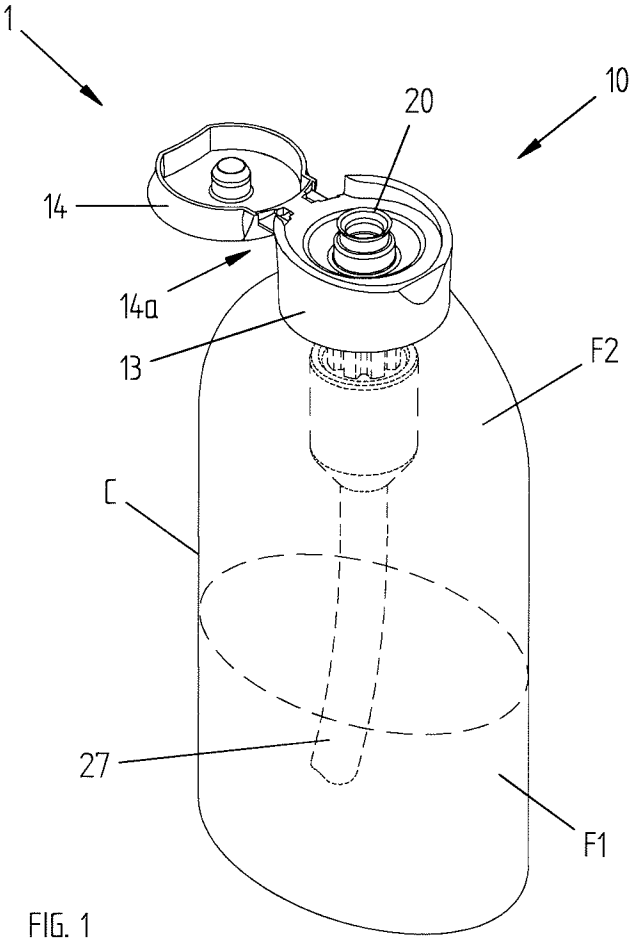
FIG. 1 shows an axonometric view of a device for dispensing a fluid associated with a container so as to obtain a dispensing system according to a preferred embodiment of the invention.
Figure 3:
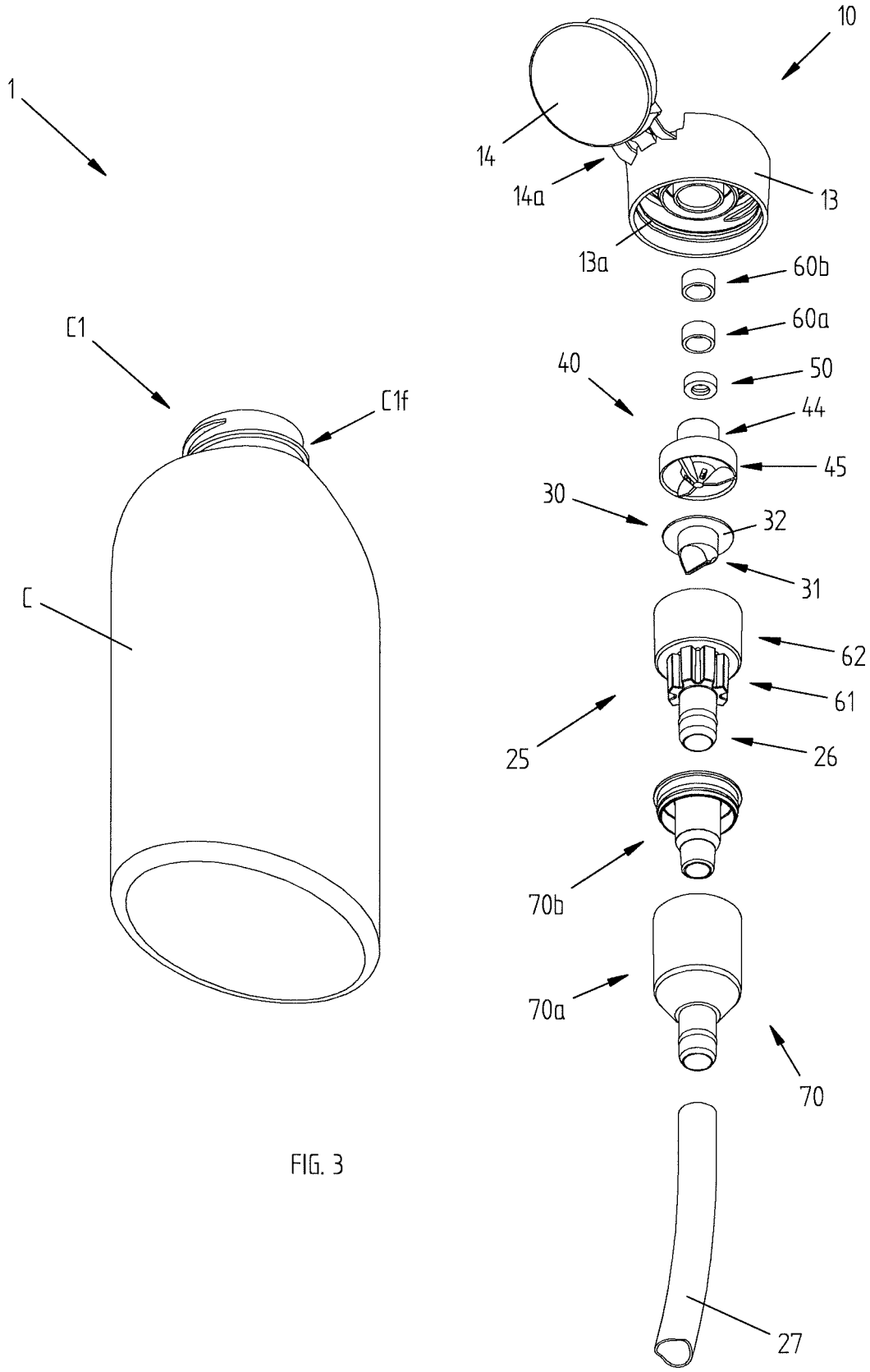
FIG. 3 shows an exploded view of the dispensing system of FIG. 1.

An example of embodiment of a system 1 for dispensing a mixture, here below simply referred to as foam S, is shown in FIGS. 1 and 2, in which a dispensing device according to the present invention, indicated as a whole by 10, is applied to the neck C1 of the container C containing the fluids F1 and F2 to be mixed. In FIG. 1 the system 1 is shown with the container C and the dispensing device 10 applied to it in the upright position, that is, with the dispensing device 10 positioned on top of the container C. The upright position will correspond to the preferred rest/storage position of the system 1 when it is not used. As will be explained below, the operating position for dispensing the foam S is the overturned or upside-down position shown in FIG. 2, meaning the position in which the container C is overturned and the dispensing device 10 is positioned under the container C itself.

Figure 12B:
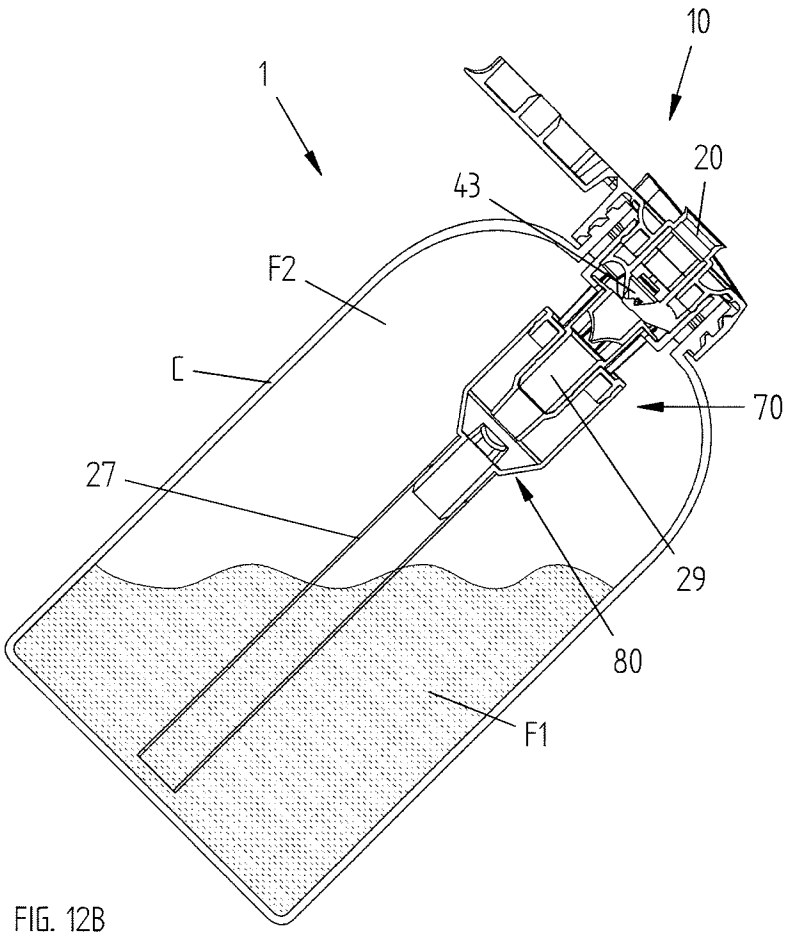
Figure 12A:
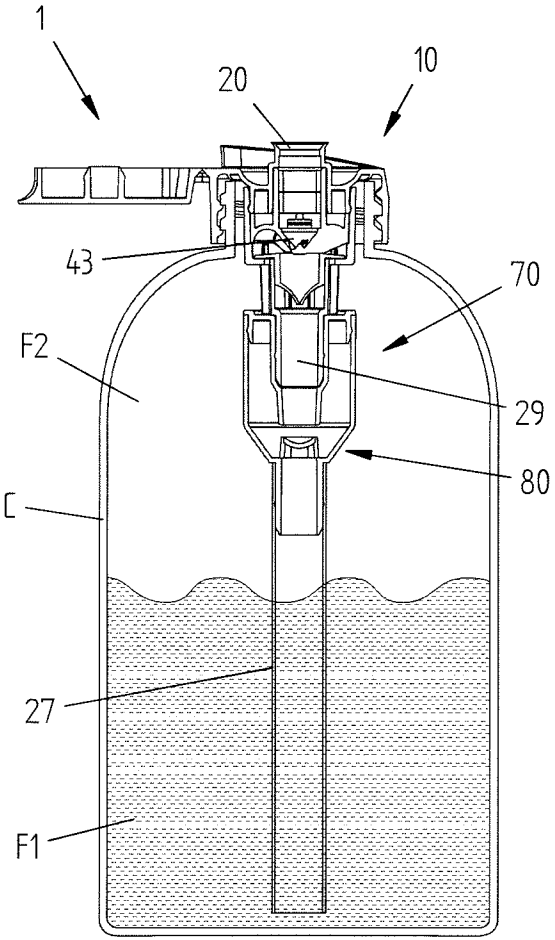
Figure 12D:
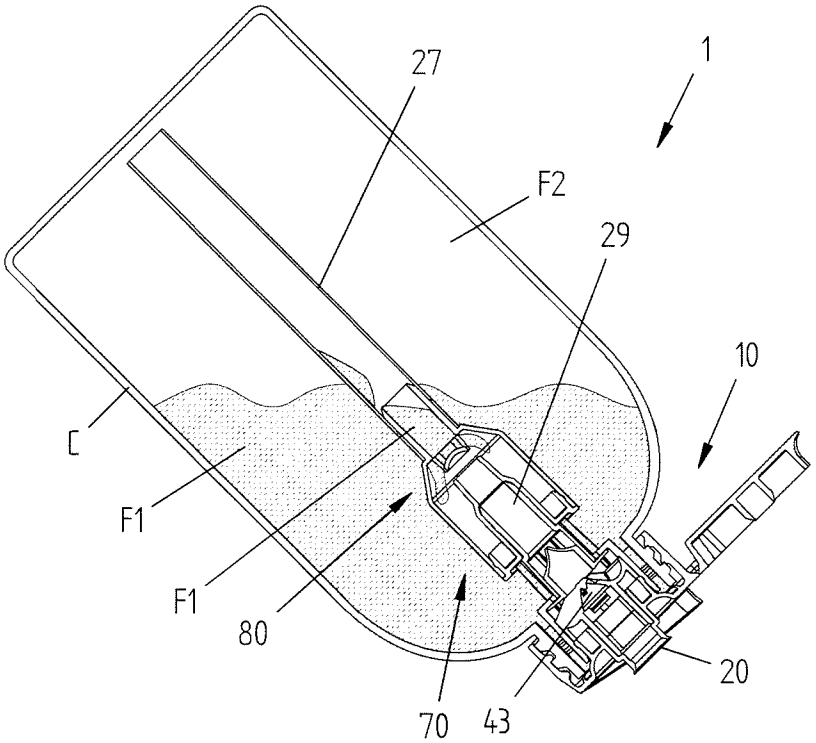
Figure 12E:
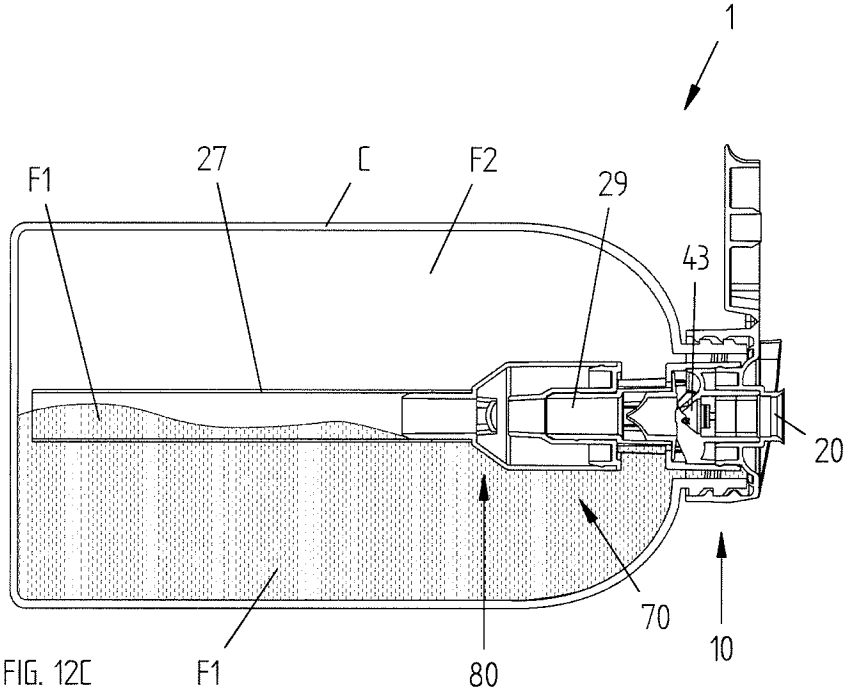
Figure 12F:
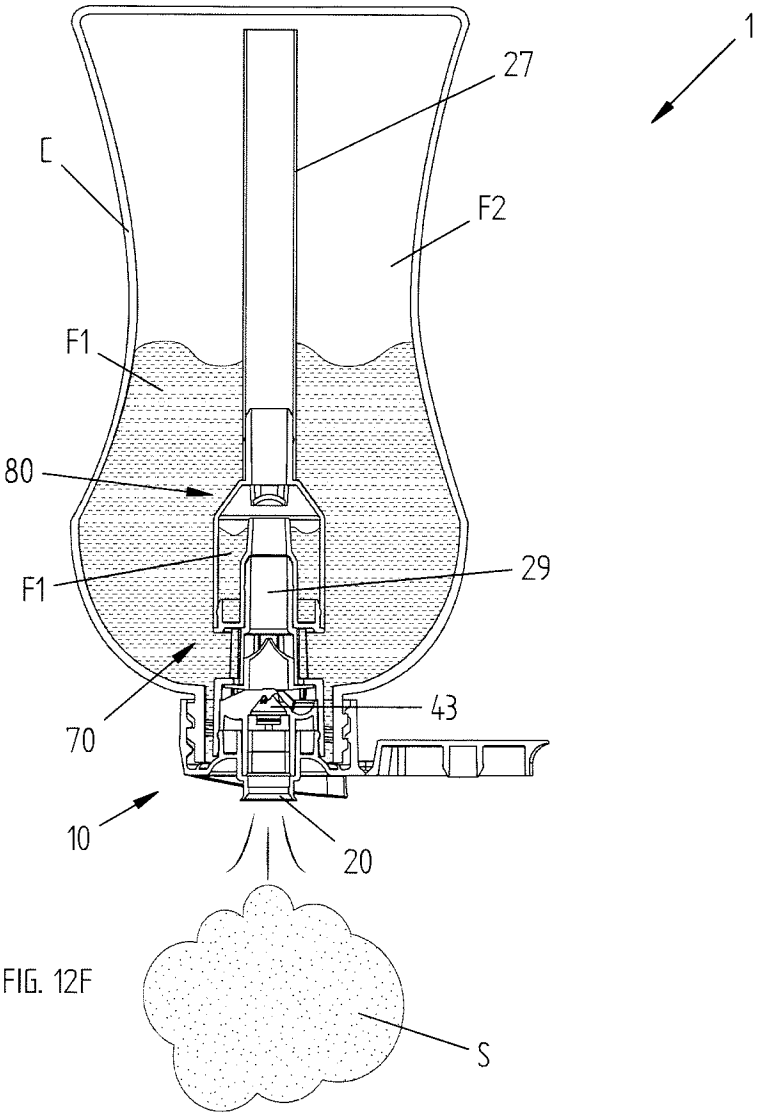
Figure 12E:
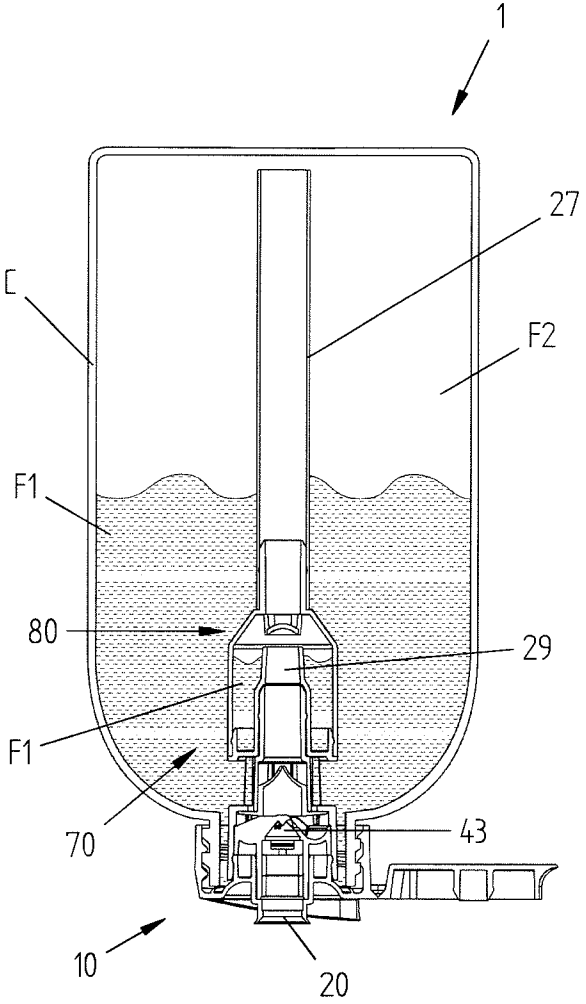

It should be noted that the container C of the invention is preferably a bottle made of a material that can be easily deformed by exerting pressure with the hand that grasps it, as shown for example in FIG. 12F, and is preferably made of a plastic material.

It is evident that this deformation can be obtained in any other manner, for example with the aid of suitable mechanisms designed to deform the external surface of the container C.

When in the upright position, said container C is filled with a first fluid F1 up to a suitable level, shown with a broken line in FIG. 1, while the remaining part above said fluid F1 will contain air, which is suited to be the second fluid F2 of the foam S to be obtained.

When the system 1 is in the overturned operating position, the first fluid F1 reaches a suitable level, shown with a broken line in FIG. 2, while the remaining part above said fluid F1 will contain the second fluid F2, that is, air.

Figure 10A:
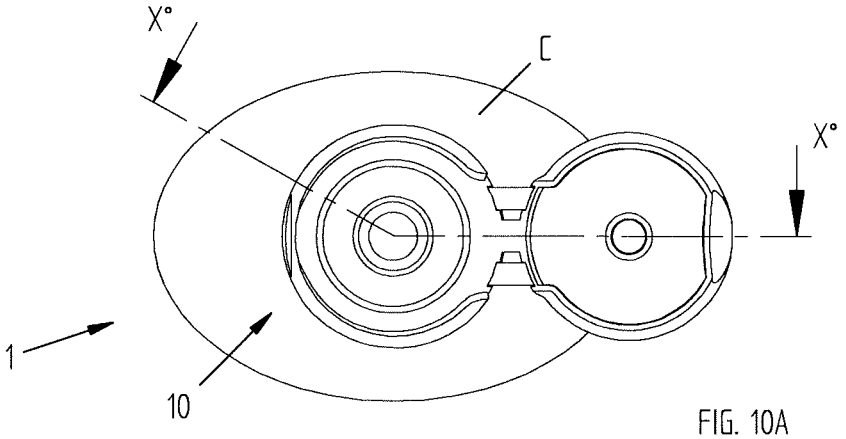
FIG. 10A shows a plan view from below of the dispensing system of FIG. 2 in overturned position during the foam dispensing operation.
Figure 10B:
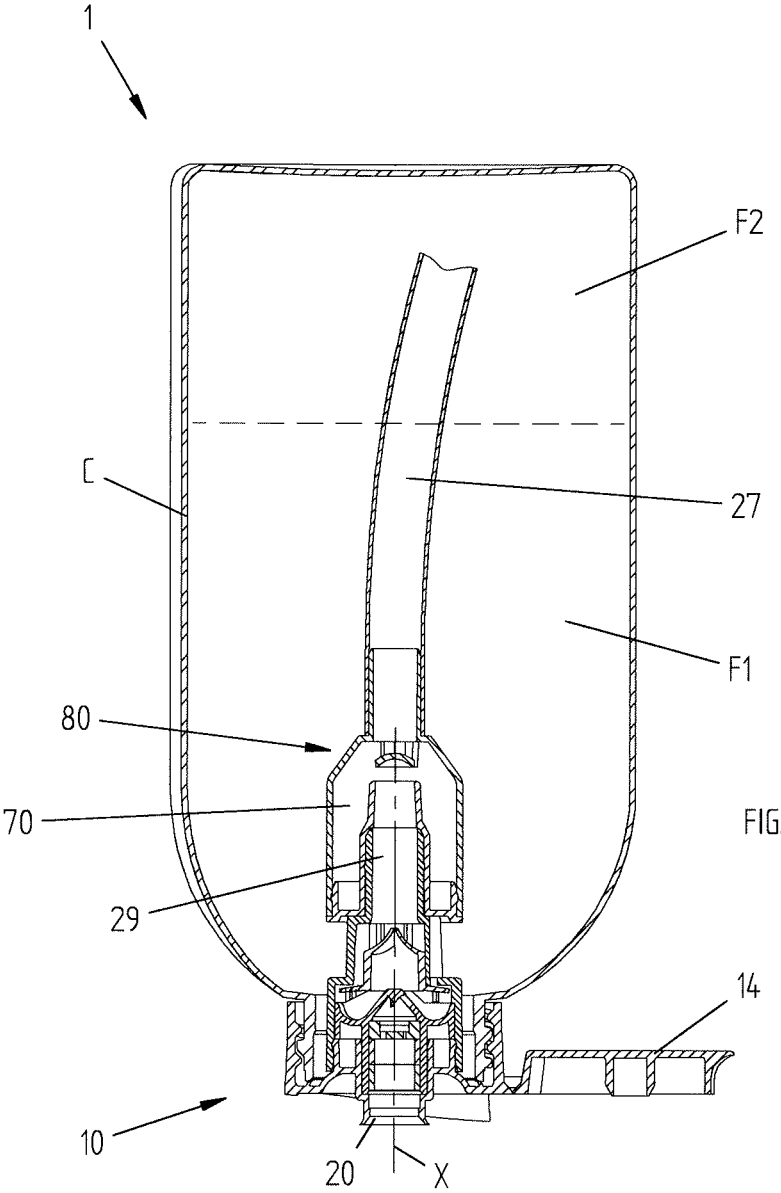
FIG. 10B shows the sectional view of FIG. 10A along section line X-X.
Figures 10C, 10D:
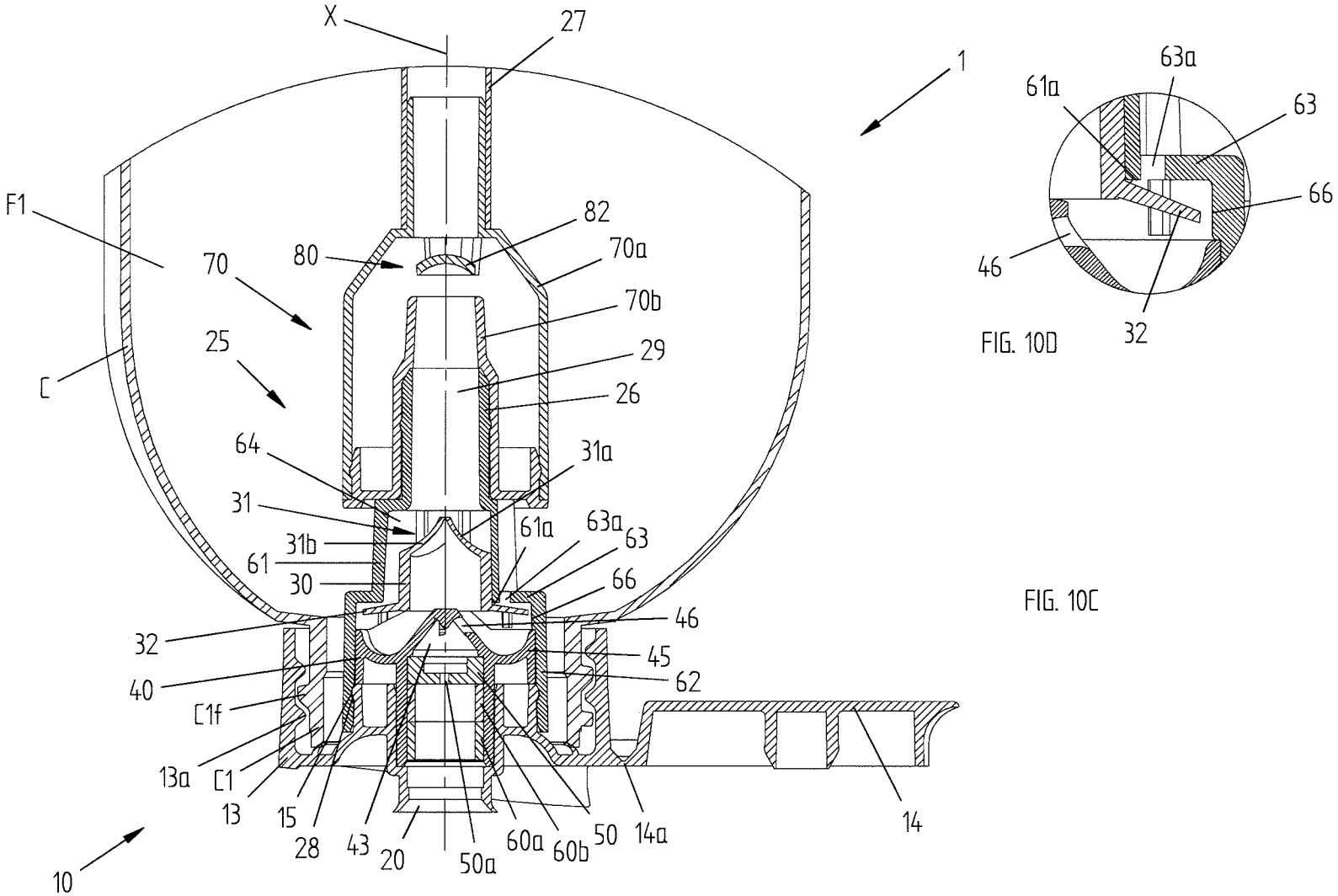
FIG. 10C shows an enlarged detail of FIG. 10B.
FIG. 10D shows an enlarged detail of FIG. 10C.

The following part of this description makes reference to a first operating step (dispensing step) in the use of the dispensing device 10, which is the step in which the system is in the overturned operating position and the container C is squeezed in order to dispense the foam S, as shown, for example, in FIGS. 10C and 12F. Reference will also be made to a second operating step (air refilling/venting step) in the use of the dispensing device 10, which is the step in which the container C is released and refilled with air, known as the venting step (shown, for example, in FIG. 11C).

While for the first operating step the container C must be in the overturned position, the second operating step, that is, the venting step, can take place independently of the position of the container C.

Figure 9A:
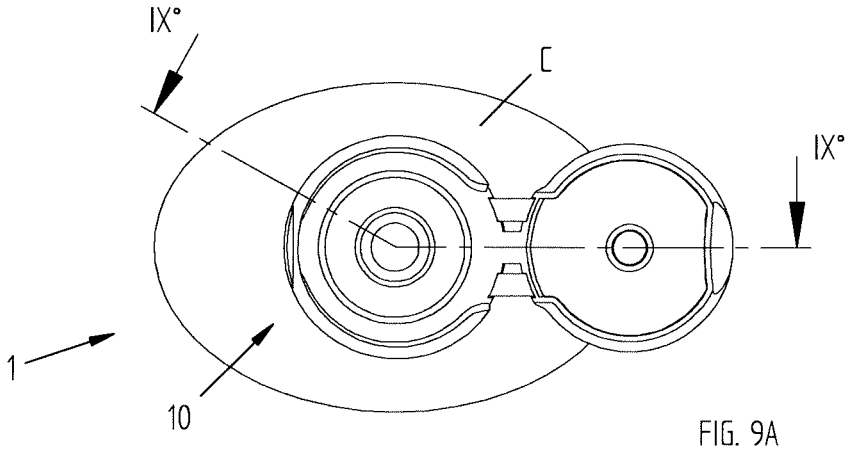
FIG. 9A shows a plan view from below of the dispensing system of FIG. 2 in overturned position and not in use.
Figure 9B:
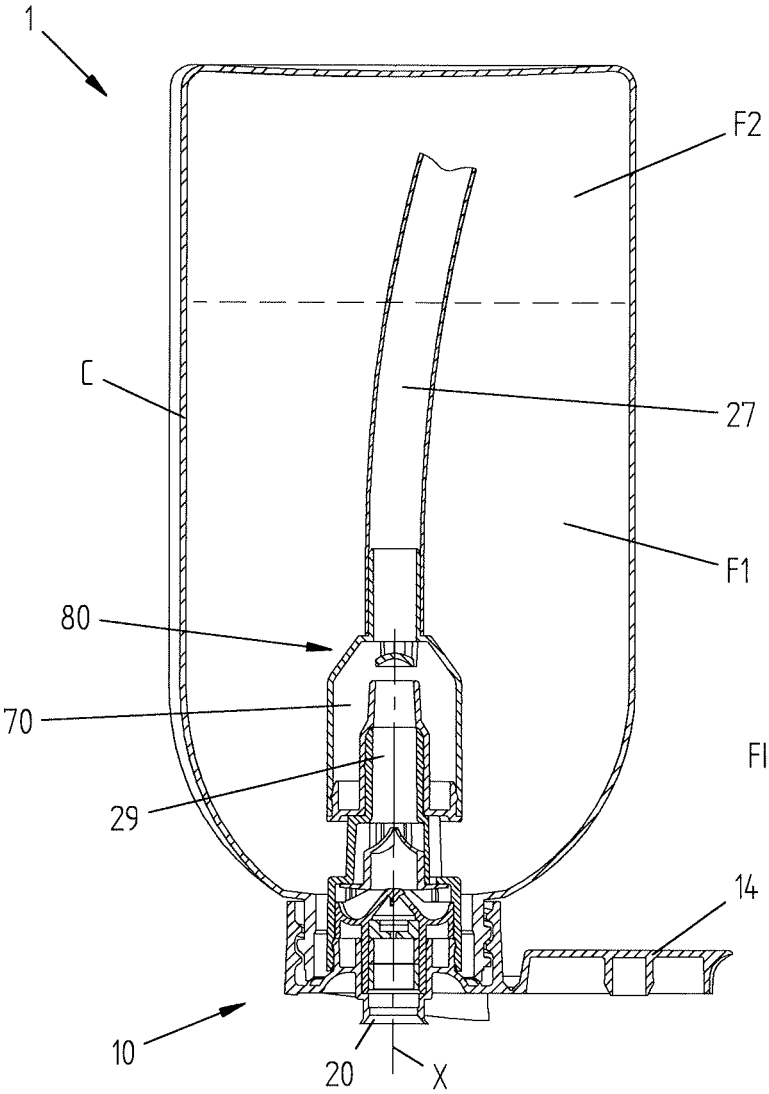
FIG. 9B shows the sectional view of FIG. 9A along section line IX-IX.

The dispensing device of the invention 10 comprises a supporting body 13, or supporting structure, provided with coupling means 13*a* for coupling it with the container C, as shown for example in FIG. 9C. Said coupling means 13*a* preferably comprise a threaded portion suited to become engaged with a corresponding threaded portion C1*f* present on the neck C1 of the container C.

In variant embodiments, said coupling means can be of a different type, for example they can be snap-on coupling means.

The supporting body 13 preferably comprises an outlet duct 20 suited to dispense the foam S. The outlet duct 20 is preferably made in a single piece with said supporting body 13, more preferably in a cylindrical shape and in the centre area of the supporting body 13. Obviously, the shape and position of the outlet duct can vary depending on the needs, be they functional and/or aesthetic needs.

The supporting body 13 is preferably associated with a closing element 14 suited to intercept the outlet duct 20 in order to close it. Preferably, the supporting body 13 and the closing element 14 are obtained in a single piece, for example through a thermoplastic moulding process.

Advantageously, the closing element 14 can be rotated around a hinge 14*a* with respect to the supporting body 13, so that it can be moved between an open position, for example that shown in the figures, and a closed position, in which it intercepts the outlet duct 20 (position not shown in the figures).

In variant embodiments the closing element can be made in a different manner, suitable for the set purpose.

Figure 6A:
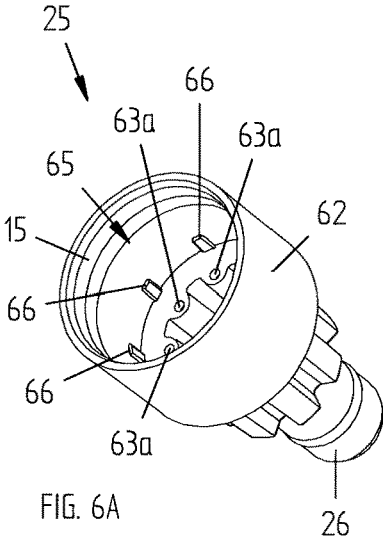
FIG. 6A shows an axonometric view of an element of FIG. 3.
Figure 6B:
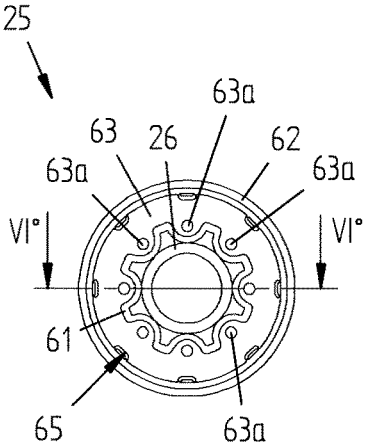
FIG. 6B shows a plan view of the element illustrated in FIG. 6A.
Figure 6C:
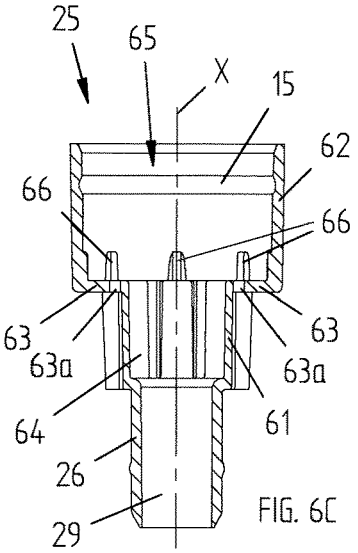
FIG. 6C shows the sectional view of FIG. 6B along section line VI-VI.

The supporting body 13 is associated with a first body 25, better illustrated in FIGS. 6A to 6C.

The first body 25 is connected to the supporting body 13 and is suited to be introduced in the container C when the dispensing device 10 is screwed onto the container C itself.

Preferably, the first body 25 is snapped onto the supporting body 13 through an annular projection 28 defined on the supporting body 13, which is fitted in a corresponding annular cavity 15 belonging to the first body 25.

In variant embodiments of the invention the first body 25 and the supporting body 13 can be mutually connected in a different manner, for example through a screwing operation.

The first body 25 comprises a first cylindrical hollow terminal portion 26 that preferably is developed substantially along a main axis X.

The hollow cylindrical end 26 defines an inlet opening 29, which preferably is developed substantially along a main axis X, too.

According to an aspect of the present invention, the first cylindrical terminal portion 26 is associated with a tank-chamber 70, visible in greater detail in FIG. 9C. The tank-chamber 70 preferably envelops at least partially the cylindrical end 26 of the first body 25. The tank-chamber 70 is preferably developed coaxially outside the cylindrical end 26 along the same main axis X. The tank-chamber receives a suction tube 27 that extends until reaching a position in proximity to the bottom of the container C.

Preferably, the tube 27 is coupled with the tank-chamber 70 through mechanical interference.

The portion of interference of the tube 27 with the tank 70 is preferably and advantageously aligned with the main axis X.

Preferably, the tank-chamber 70 defines a volume which is suited to contain a quantity of the fluid F1 that, in particular conditions, can completely or partially fill the tube 27, as is explained in greater detail below. Therefore, the tank-chamber 70 preferably has a volume that at least exceeds the volume defined by the tube 27 and this because, as explained below, the volume of any fluid F1 present in the tube 27 is transferred into said tank-chamber 70.

In the embodiment illustrated and described herein the tank-chamber 70 is preferably made by mutually coupling together two distinct elements 70*a*, 70*b*. In variant embodiments, however, there may be a different number of elements and the tank-chamber 70 may also be made with a single piece.

According to an aspect of the present invention, deviation means 80 are preferably associated between the suction tube 27 and the tank-chamber 70.

The deviation means 80 are conveniently shaped in such a way as to deviate any first fluid F1 coming from the tube 27 towards the tank-chamber 70.

The deviation means 80 preferably comprise an element 82 positioned coaxially with the tube 27 and upstream of the inlet opening 29 of the first body 25.

The element 82 is positioned so as to substantially protect the inlet opening 29 of the first body 25 from a fluid coming from the tube 27 and to deviate the flow of said fluid externally towards the tank-chamber 70.

Preferably, the element 82 is circular, which means that it has the same shape as the tube 27, and preferably convex with its convex part facing towards the tube 27 in order to favour the flow and the deviation of the fluid towards the tank-chamber 70.

Preferably, the deviation element 82 is made in a single piece with the second body 70, preferably in a single piece with the first element 70*a* of the second body 70.

Figure 4A:
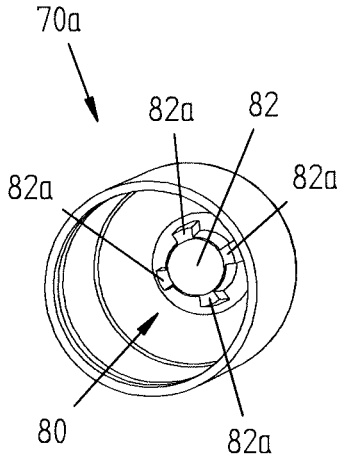
FIG. 4A shows an axonometric view of an element of FIG. 3.
Figure 4B:
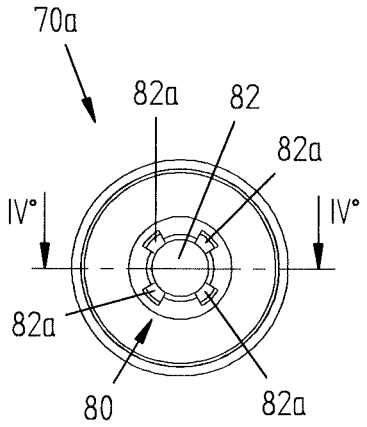
FIG. 4B shows a plan view of the element illustrated in FIG. 4A.
Figure 4C:
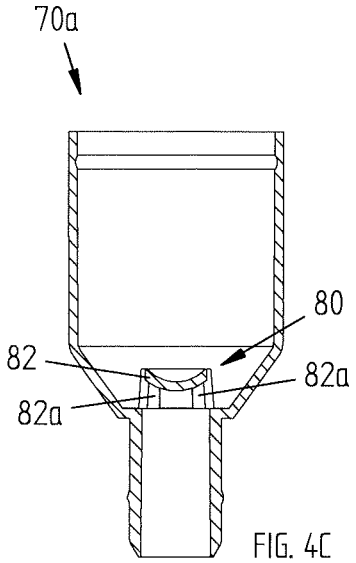
FIG. 4C shows the sectional view of FIG. 4B along section line IV-IV.
Figure 4D:
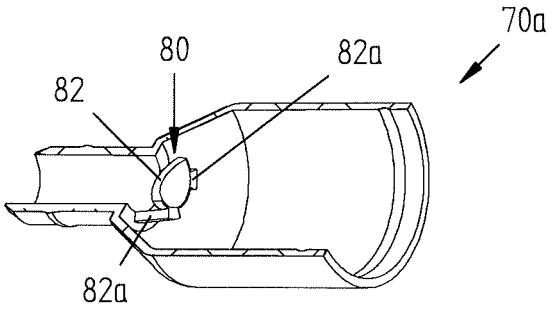
FIG. 4D shows a partial sectional axonometric view of the element illustrated in FIG. 4A.
Figure 4E:
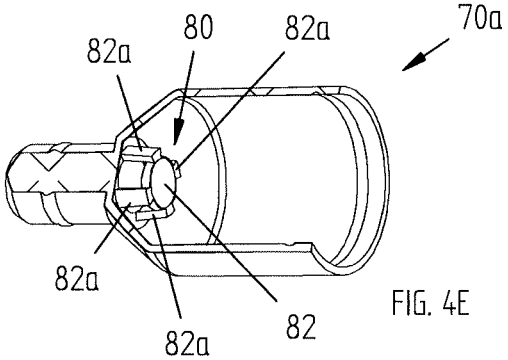
FIG. 4E shows another partial sectional axonometric view of the element illustrated in FIG. 4A.
Figure 5A:
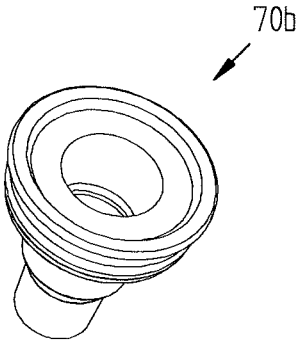
FIG. 5A shows an axonometric view of an element of FIG. 3.
Figure 5B:
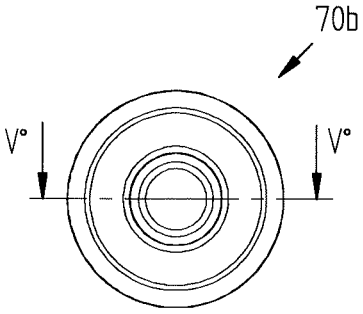
FIG. 5B shows a plan view of the element illustrated in FIG. 5A.
Figure 5C:
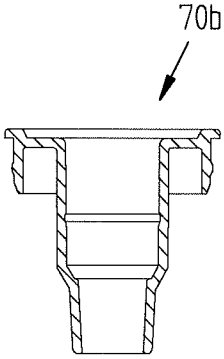
FIG. 5C shows the sectional view of FIG. 5B along section line V-V.

For this purpose, as shown in FIG. 4E, ribs 82*a* join the deviation element 82 to the first element 70*a*.

Returning now to the first body 25, this contains the other elements of the dispensing device 10, that is:

a valve element 30;

a mixer element 40;

a diffuser element 50;

two filtering elements 60*a*, 60*b*.

It should be noticed that the various elements shown and described herein, in particular the first body 25, the tank-chamber 70, the valve element 30, the mixer element 40, the diffuser element 50 and the filtering elements 60*a*, 60*b*, are preferably developed coaxially around the main axis X and therefore preferably have a partially or completely cylindrical shape. In variant embodiments, however, the shapes of the various elements can be different and obviously these will be conveniently made, so that they can be coupled with each other.

In addition to the first cylindrical portion 26, the first body 25 has a second substantially cylindrical portion 61 and a third cylindrical portion 62.

The second portion 61 has a radial dimension that is smaller compared to that of the third cylindrical portion 62, both of which can be seen in greater detail in FIG. 6C. The second portion 61 and the third cylindrical portion 62 are joined by a connection surface 63. The connection surface 63 is preferably annular and preferably lies on a plane which is perpendicular to the main axis X. In variant embodiments the connection surface can be shaped in a different manner.

The third cylindrical portion 62 is advantageously provided with said annular cavity 15 suited to allow it to be coupled with the supporting body 13.

The second portion 61 internally defines a first chamber 64 containing the valve element 30 (see FIG. 9C).

The first cylindrical portion 26 of the first body 25 ends into said first chamber 64 in such a way as to convey the second fluid F2 during use, as is explained below.

The third cylindrical portion 62 internally defines a second chamber 65 containing the mixer element 40.

Ribs 66 define respective supporting surfaces for the mixer element 40 and define its position inside the second chamber 65, as can be seen for example in FIG. 9C.

The connection surface 63 preferably comprises a plurality of holes 63*a* that lead into said second chamber 65 in such a way as to convey the first fluid F1 during use, as explained below.

In the embodiment illustrated herein there are preferably eight cylindrical holes 63*a* equally distributed on the connection surface 63. In variant embodiments, however, a different number of holes can be provided, even one only, in a different position and/or with a different shape.

Figure 7A:
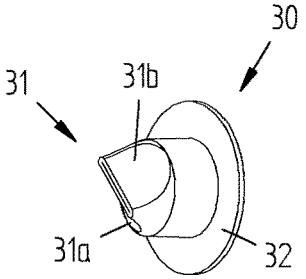
FIG. 7A shows an axonometric view of an element of FIG. 3.
Figure 7B:
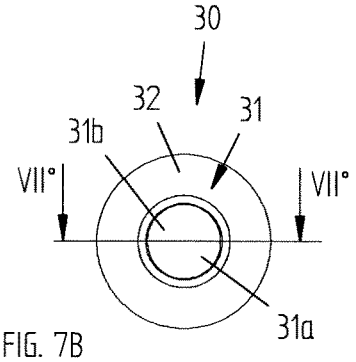
FIG. 7B shows a plan view of the element illustrated in FIG. 7A.
Figure 7C:
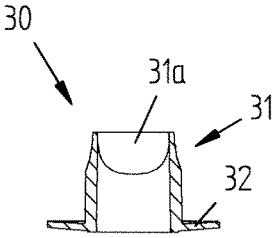
FIG. 7C shows the sectional view of FIG. 7B along section line VII-VII.
Figure 11A:
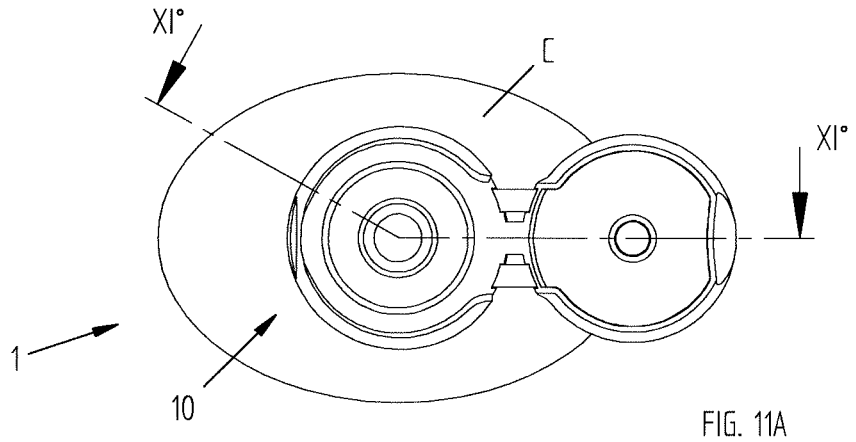
FIG. 11A shows a plan view from below of the dispensing system of FIG. 2 in overturned position during the air venting step.
Figure 11B:
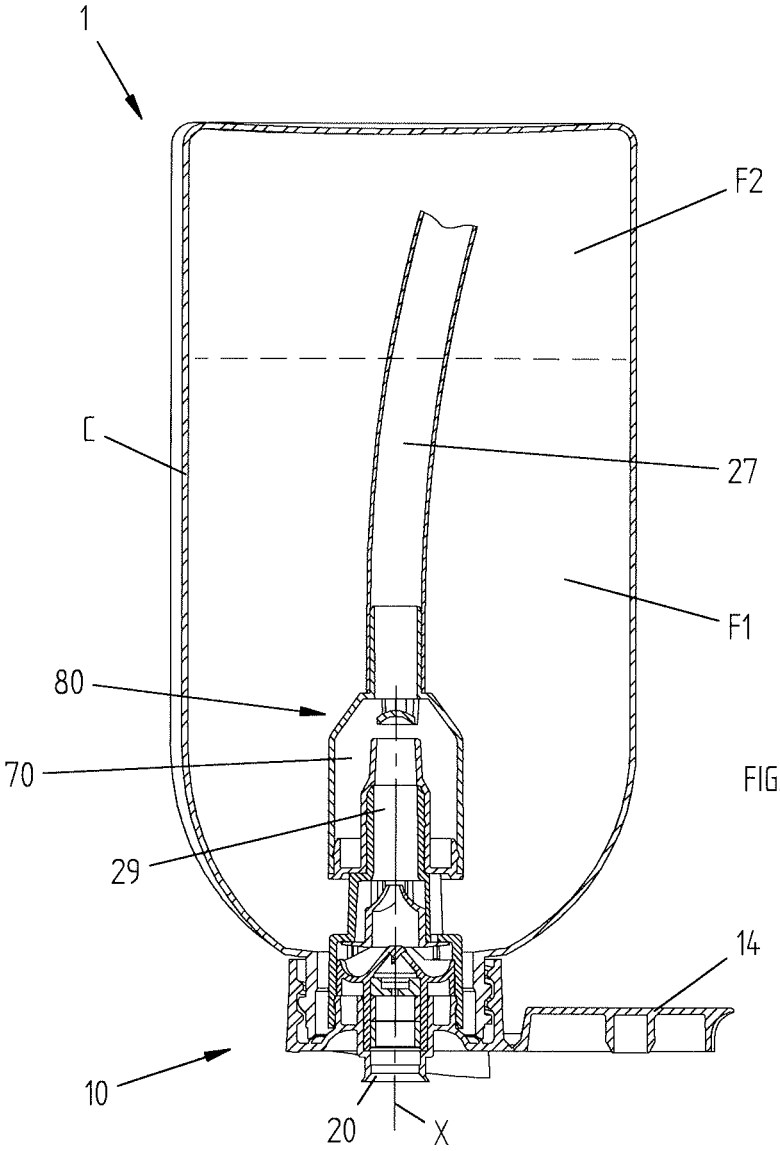
FIG. 11B shows the sectional view of FIG. 11A along section line XI-XI.
Figure 11C:
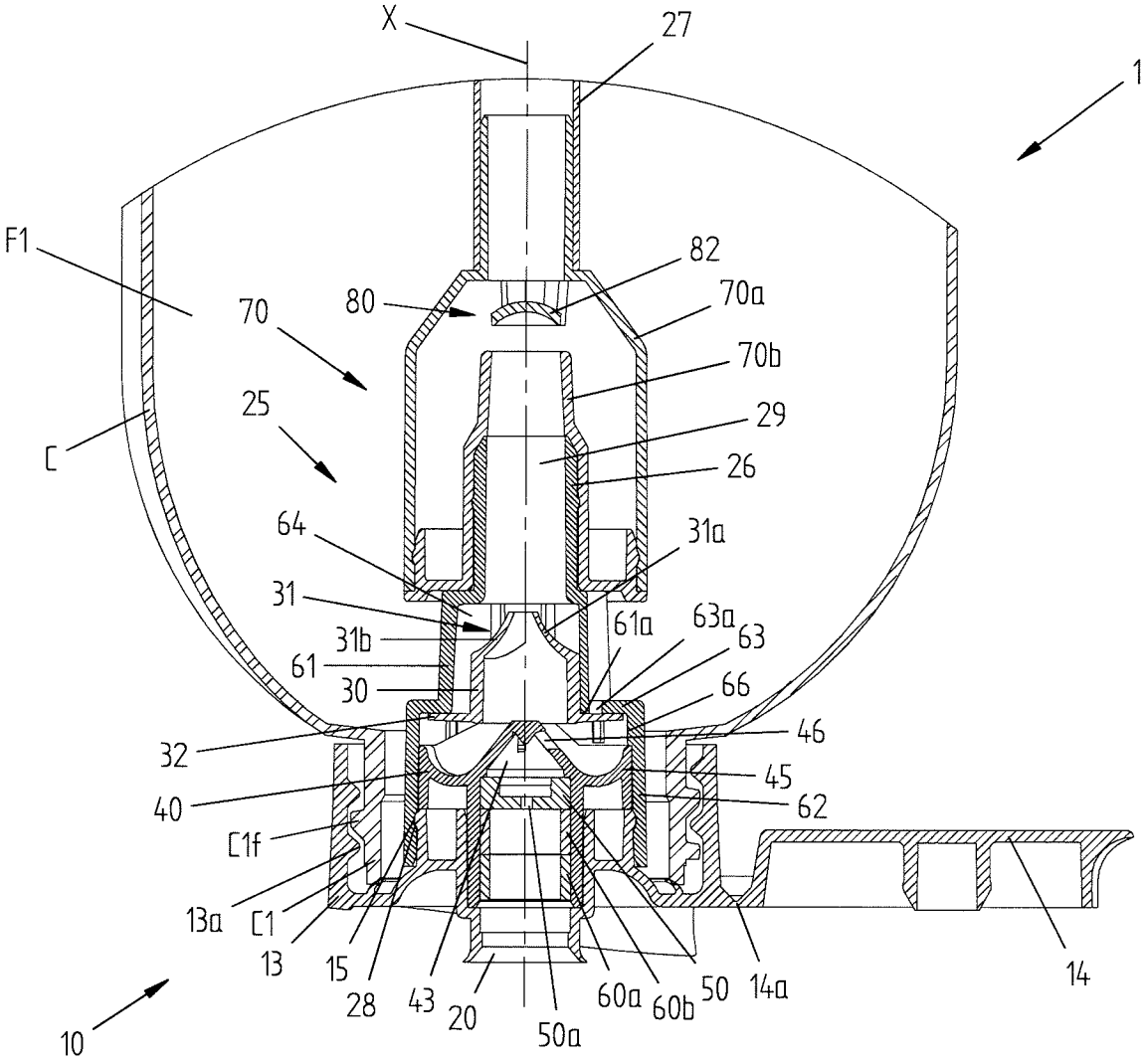
FIG. 11C shows an enlarged detail of FIG. 11B.

Concerning the valve element 30, better illustrated in FIGS. 7A to 7C, it preferably comprises a first shaped valve portion 31 comprising two at least partially flexible edges 31*a*, 31*b* normally arranged in contact with each other (closed position), especially during the dispensing step (first operating step) of the system 1, and separate from each other (open position) during the venting step (second operating step) of the system 1, as shown for example in FIG. 11C. The first shaped valve portion 31 actually defines a normally closed valve, as explained in detail here below.

The valve element 30 comprises also an at least partially flexible annular edge 32.

The annular edge 32 is normally arranged in contact with the annular edge 61*a* of the second portion 61 and at the same time in the position in which it closes the holes 63*a* of the connection surface 63, as shown in FIG. 9C, 9D or 11C.

This position of the annular edge 32 (closed position) is assumed when the system is not in use or even during the venting step of the system 1, as shown for example in FIG. 11C.

Instead, the annular edge 32 assumes an open position, that is, a position in which it is not in contact with the annular edge 61*a* of the second portion 61 and in which at the same time the holes 63*a* of the connection surface 63 are open, during the dispensing step of the system 1. This position is shown in particular in FIGS. 10C and 10D.

The annular edge 32 assumes the open position during the dispensing step when the container C is squeezed and, on the one side, the first fluid F1 flows in through the holes 63*a* of the connection surface 63 of the first body 25 and, on the other side, the second fluid F2 coming from the tube 27 flows through the inlet opening 29 and the first chamber 64 of the first body 25 and, coming into contact with the outside of the valve element 30, reaches the annular edge 32. The thrusting effect of the two fluids F1, F2 moves and opens the annular edge 32.

The valve element 30 is preferably made of a flexible material, more preferably of a silicone-based material.

Figure 8A:
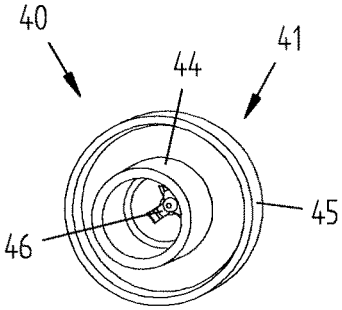
FIG. 8A shows a first axonometric view of an element of FIG. 3.
Figure 8C:
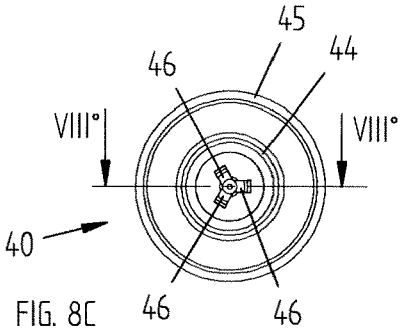
FIG. 8C shows a plan view of the element illustrated in FIG. 8A.
Figure 8B:
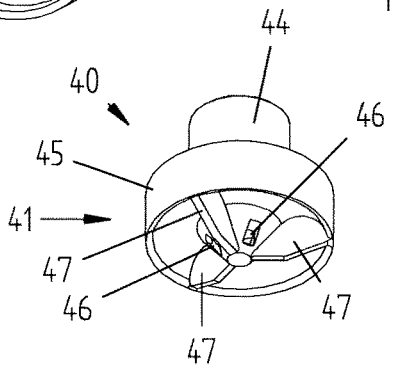
FIG. 8B shows a different axonometric view of the element illustrated in FIG. 8A.
Figure 8D:
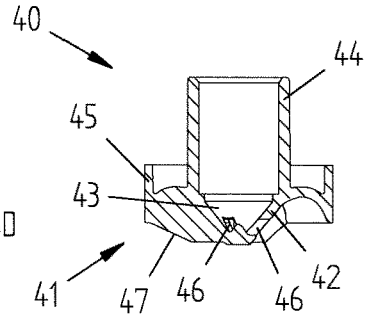
FIG. 8D shows the sectional view of FIG. 8C along section line VIII-VIII.

Regarding the mixer element 40, illustrated in greater detail in FIGS. 8A to 8C, it preferably comprises a first terminal portion 41 facing towards the valve element 30, a second portion 42, or mixing portion, inside which a mixing chamber 43 is defined, and a third portion 44 defining a seat suited to house means for the formation of the foam S.

The first terminal portion 41 comprises a cylindrical portion 45 that comes into contact with said ribs 66 provided on the first body 25, at a predetermined distance from the valve element 30. The cylindrical portion 45 advantageously makes it possible to centre the mixer element 40 inside the second chamber 65 of the first body 25 and to keep it in position when the supporting body 13 is assembled on the first body 25.

The first terminal portion 41 preferably comprises openings 46 that are in communication with the mixing chamber 43. In variant embodiments several holes, conveniently distributed, may be provided.

Three ribs 47, visible in FIG. 8B, are preferably defined on the surface of the first terminal portion 41 facing the valve element 30. Preferably, each rib 47 has a trapezoidal shape.

The ribs 47 actually define a stop element for the maximum opening of the annular edge 32. During the dispensing operation, the annular edge 32 thus advantageously comes into contact with said ribs 47.

It is evident that in variant embodiments the number and shape of said ribs can be different from those illustrated herein.

The third portion 44 of the mixer element 40 contains the diffuser element 50 and the filtering elements 60*a*, 60*b*.

The diffuser element 50 preferably comprises a diffuser hole 50*a*, visible for example in FIGS. 9C and 10C, suited to receive the mixture from the mixing chamber 43 and to convey it towards the filtering elements 60*a*, 60*b*.

In the present embodiment there is one hole 50*a* only. In variant embodiments, however, a different number of holes, with a suitable shape and in a suitable position, can be provided on the diffuser element.

The filtering elements 60*a*, 60*b* are advantageously provided at the centre with suitable micro holes that, also according to the viscosity characteristics of the fluid F1, allow the formation of the foam S comprising micro air bubbles F2 mixed with the fluid F1.

The operation of the system 1 is described here below, paying special attention to the first operating step (dispensing step), with reference to FIGS. 10C and 10D, and to the second operating step (venting step), with reference to FIG. 11C.

In order to carry out the dispensing step, the system 1 is arranged in overturned position and the container C is squeezed.

The first fluid F1, for example liquid soap, is subjected to pressure and conveyed towards the holes 63*a* of the connection surface 63 and thus against the annular edge 32. At the same time, the second fluid F2, for example air, is subjected to pressure and conveyed by the tube 27 through the inlet opening 29 of the first body 25, the first chamber 64 and outside the valve element 30 and then against the annular edge 32, too.

The annular edge 32 thus assumes its open position towards and possibly against the ribs 47 and the two fluids F1, F2 are conveyed into the mixing chamber 43 through the openings 46 of the mixer element 40.

Therefore, preferably, the first body 25 defines, together with the valve element 30, a first conveyance way designed to convey the first fluid F1 from the container C to the mixing chamber 43, and a second conveyance way designed to convey the second fluid F2 from the container C to the mixing chamber 43, wherein, more preferably, the first conveyance way comprises the holes 63*a* of the connection surface 63 and the second conveyance way comprises said first chamber 64.

From the inside of the mixing chamber 43, the mixture of the two fluids F1 and F2 flows through the diffuser element 50 and then through the filtering elements 60*a*, 60*b* for the formation of the foam S which is expelled from the outlet duct 20.

In order to carry out the air refilling/venting step, the container C is released. When the container C is released, the negative pressure inside the container C causes the return movement of the annular edge 32 that comes into contact with the annular edge 61*a* of the second portion 61 and at the same time closes the holes 63*a* of the connection surface 63, as shown in FIG. 11C.

At the same time, the negative pressure inside the container C causes the opening of the edges 31*a*, 31*b* of the first shaped valve portion 31 of the valve element 30. Through the opening between the edges 31*a*, 31*b*, a quantity of air is drawn in to restore the quantity of fluids F1 and F2 corresponding to that expelled during the previous dispensing step.

The refilling air drawn in, as can be understood from FIG. 11C, follows the route from the outlet duct 20, through the filtering elements 60*a*, 60*b*, the diffuser element 50, the mixing chamber 43, the centre openings 46 of the mixer element 40, the opening between the two edges 31*a*, 31*b*, the inlet opening 29 of the first body 25 and finally the tube 27 to reach the inside of the container C.

At the end of the release step, the two edges 31*a*, 31*b* return to their normally closed position and the system 1 is ready for a new dispensing cycle.

Advantageously, in the device 10 according to the invention the flexible edge 32 of the valve element 30 constitutes the control element both with regard to the passage of the first fluid F1 from the inside of the container C towards the mixing chamber 43 and with regard to the passage of the second fluid F2 from the inside of the container C towards the mixing chamber 43. This makes it possible to simplify the construction structure of the device compared to the systems provided with distinct valve means for controlling the first fluid F1 and the second fluid F2.

This furthermore leads to the simplification of the operations required for the assembly of the device compared to the systems known in the art.

Furthermore, this leads to a reduction in the production costs of the dispensing device 10 and of the system 1, since simpler elements are used, and their assembly times are reduced.

To further advantage, in the device 10 according to the invention also the flexible edges 31*a*, 31*b* that control the air venting towards the inside of the container preferably belong to the same valve element 30 on which the flexible edge 32 is defined which controls the passage of both fluids F1 and F2 from the container C towards the mixing chamber. This makes it possible to further simplify the construction structure of the device compared to the systems provided with distinct valve means for controlling the fluids and the refilling air.

This leads to a further simplification of the operations required for the assembly of the device compared to the systems of the known type.

Furthermore, this results in a further reduction in the production costs of the dispensing device 10 and of the system 1, since simpler elements are used, and their assembly times are reduced.

The operation of the system 1 and the function of the tank-chamber 70 are described here below with reference to FIGS. 12A to 12E.

In order to dispense the foam S, the system 1 is brought from the upright position (FIG. 12A) to the overturned position (FIG. 12E) and the container C is squeezed (FIG. 12F).

During the rotation of the system 1 from the upright position to the overturned position, a portion of the first fluid F1, for example liquid soap, is inconveniently conveyed into the tube 27, as indicated for example in FIGS. 12C and 12D.

However, to advantage, during the rotation of the system 1 the first fluid F1 is conveyed from the tube 27 into the tank-chamber 70 owing to the operation of the deviation means 80, as shown in FIG. 12D.

The shape of the deviation means 80 themselves, as described above, together with said effect of deviation of the first fluid F1, makes it possible to prevent a part of the first fluid F1 itself from flowing through the inlet opening 29 of the first body 25.

When the system 1 reaches the overturned position and is ready for the dispensing operation (FIG. 12E), all the first fluid F1 which was previously contained in the tube 27 is transferred into the tank-chamber 70 and the tube 27 is empty, so that the second fluid F2 (for example, air) can flow therein.

Already from the first pressure exerted on the container C, therefore, the correct quantity of the first and second fluid F1, F2 is conveyed into the mixing chamber 43, as described above with reference in particular to FIG. 9C. The first fluid F1 in the tank-chamber 70 does not affect the correct dispensing of the foam S.

When the system 1 is rotated to bring it from the overturned position to the upright position, the quantity of first fluid F1 present in the tank-chamber 70 is conveyed back into the container C.

According to an advantageous aspect of the present invention, the presence of said deviation means 82 makes it possible to arrange the tube 27 in an aligned position with respect to the inlet opening 29 of the first body 25, where the second fluid F2 must flow. This makes it possible to reduce the overall dimensions of the device 10 compared to the devices of the known type.

It has thus been shown by means of this description that the dispensing device according to the present invention makes it possible to achieve the set objects. More specifically, the dispensing device according to the present invention makes it possible to simplify the construction structure and/or the assembly operations compared to the systems of the known type.

Even if the present invention has been illustrated above through the detailed description of an embodiment represented in the drawings, the present invention is not limited to the embodiment described above and shown in the drawings; on the contrary, further variants of the embodiment described herein fall within the scope of the present invention, which is defined in the claims.

The invention claimed is:

1. A device for dispensing a mixture consisting of a first fluid and a second fluid, said device being suited to be applied to a container containing said first and second fluids and comprising:

an outlet duct for said mixture;

at least one mixing chamber suited to receive and/or allow transit of a quantity of said first fluid and a quantity of said second fluid;

a foam generation element arranged in said mixing chamber upstream of said outlet duct;

a suction tube suited to draw and convey said second fluid into said mixing chamber;

a tank-chamber arranged between said suction tube and said mixing chamber, said tank-chamber being suited to store a quantity of said first fluid coming from said suction tube thereby preventing said first fluid from being conveyed to the mixing chamber, said mixing chamber;

a deviation element positioned coaxially with the suction tube and upstream of the inlet opening to deviate said first fluid coming from said suction tube towards said tank-chamber; wherein a portion of interference of the suction tube is received in the tank-chamber and substantially aligned with a main axis thereof;

a first body, connected to the tank-chamber and having a hollow cylindrical end defining an inlet opening for the second fluid the main axis, and wherein the deviation element prevents said first fluid from flowing through the inlet opening.

2. The device according to claim 1 further comprising a first valve comprising at least one first movable element suited to control passage of said first fluid from container towards said mixing chamber;

a second valve comprising at least one second movable element suited to control the passage of said second fluid from the container towards said mixing chamber;

a third valve comprising at least one third movable element suited to control the passage of a quantity of air into the container.

3. The device according to claim 2 wherein at least two among said first movable element, said second movable element and said third movable element form a single, unitary valve element.

4. The device according to claim 3 wherein all of said first movable element, said second movable element and said third movable element form the single, unitary valve element.

5. The device according to claim 4 wherein said first movable element and said second movable element are formed together as a first flexible edge of said single, unitary valve clement, said first flexible edge configured to interrupt passage of said first fluid from the container towards said mixing chamber when in a closed position and, separately, to interrupt the passage of said second fluid from the container towards said mixing chamber when in an open position, thereby allowing either said first fluid or second fluid to pass from the container towards said mixing chamber.

6. The device according to claim 3 wherein said third movable element comprises at least one flexible edge of the single, unitary valve element so as to prevent the passage of said first fluid and the passage of said second fluid from the container when in a closed position and to allow the passage of into the container when in the open position.

7. The device according to claim 6 wherein said at least one third movable element comprises at least two flexible edges configured to be in physical contact in said closed position and to be spaced apart in said open position.

8. The device according to claim 3 wherein the single, unitary valve element comprises:

a first flexible edge defining said first movable element and said second movable element; and two flexible edges defining said at least one third movable element.

9. The device according to claim 3 wherein the first body receives said single, unitary valve element so as to define a first conveyance way for said first fluid to flow from said container to said mixing chamber and, separately, a second conveyance way for the said second fluid to flow from said container to said mixing chamber.

10. The device according to claim 3 wherein said mixing chamber forms mixer element arranged between said single, unitary valve element and said outlet duct.

11. The device according to claim 5 a mixer element comprises stop element positioned between said first movable element and said second movable element.

12. The device according to claim 11 stop element prevents movement of said first flexible edge.

13. The device according to claim 1 wherein said foam generation element comprises a diffuser element and at least one filtering element.

14. The device according to claim 13 wherein said diffuser element and said at least one filtering element are housed in a seat of a mixer element.

15. The device according to claim 1 wherein the foam is formed from said first fluid and micro bubbles of said second fluid.

16. The device according to claim 15 wherein said second fluid is air.

17. The device according to claim 1 wherein the container is deformable.

18. The device according to claim 3 wherein said third valve restores air inside said container.

* * * * *